United States Patent [19]

Bonerb

[11] Patent Number: 4,673,112

[45] Date of Patent: Jun. 16, 1987

[54] MATERIAL HANDLING BINS WITH INFLATABLE LINERS

[75] Inventor: Timothy C. Bonerb, North Conway, N.H.

[73] Assignee: Vincent C. Bonerb, Boston, N.Y.

[21] Appl. No.: 726,328

[22] Filed: Apr. 23, 1985

Related U.S. Application Data

[63] Continuation-in-part of Ser. No. 686,532, Dec. 26, 1984, which is a continuation-in-part of Ser. No. 500,821, Jun. 3, 1983, Pat. No. 4,574,984.

[51] Int. Cl.[4] ..... B65D 88/62

[52] U.S. Cl. ..... 222/386.5; 222/389

[58] Field of Search ..... 222/202, 203, 386.5, 222/389, 95, 105; 280/743; 406/90, 91

[56] References Cited

U.S. PATENT DOCUMENTS

| | | | |
|---|---|---|---|
| 2,956,839 | 10/1960 | Hermanns | 222/386.5 |
| 3,421,663 | 1/1969 | Paton | 222/386.5 X |
| 4,421,250 | 12/1983 | Bonerb et al. | 222/95 |
| 4,449,646 | 5/1984 | Bonerb et al. | 222/95 |
| 4,453,645 | 6/1984 | Cesui et al. | 222/386.5 |
| 4,476,998 | 10/1984 | Bonerb et al. | 222/61 |

FOREIGN PATENT DOCUMENTS

| | | | |
|---|---|---|---|
| 0121419 | 10/1984 | European Pat. Off. . | |
| 2351425 | 10/1973 | Fed. Rep. of Germany | 222/203 |
| 1144162 | 3/1969 | United Kingdom | 52/197 |

*Primary Examiner*—Joseph J. Rolla
*Assistant Examiner*—Frederick R. Handren
*Attorney, Agent, or Firm*—Bernard, Rothwell & Brown

[57] ABSTRACT

A material-handling, pneumatic discharge-assisted, dual-walled, cup-shaped bag is provided with means in the form of battens or stiffened fabric to prevent the bottom of the inner wall of the bag from wrinkling and accumulating near the discharge opening on deflation of the bag.

6 Claims, 14 Drawing Figures

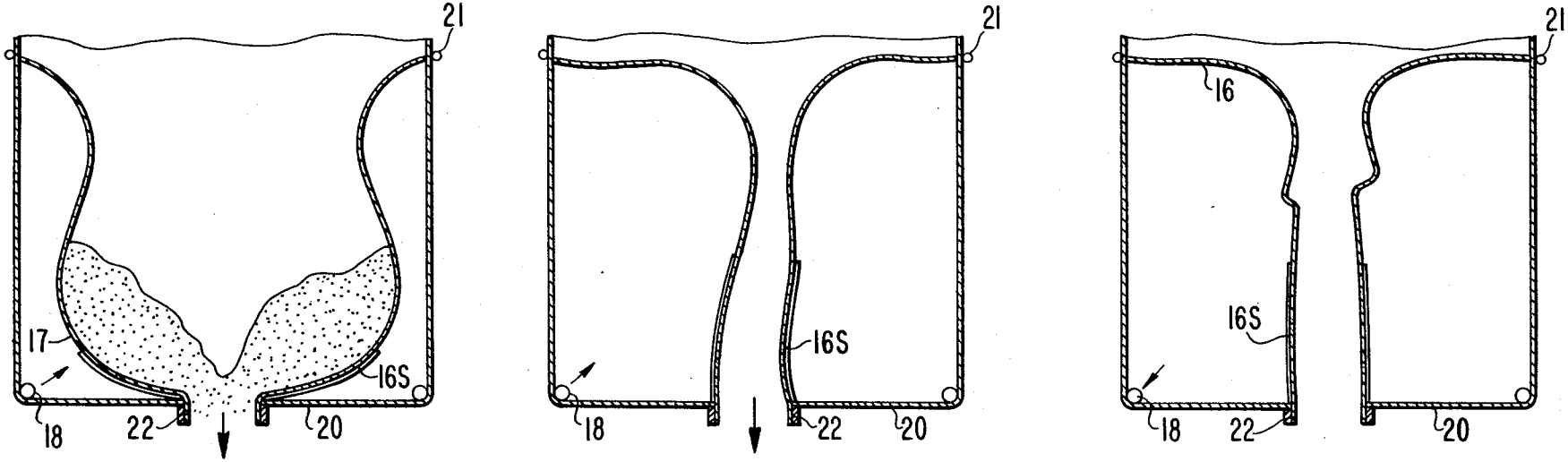
FIG. 2a
FIG. 2b
FIG. 2c
FIG. 2d
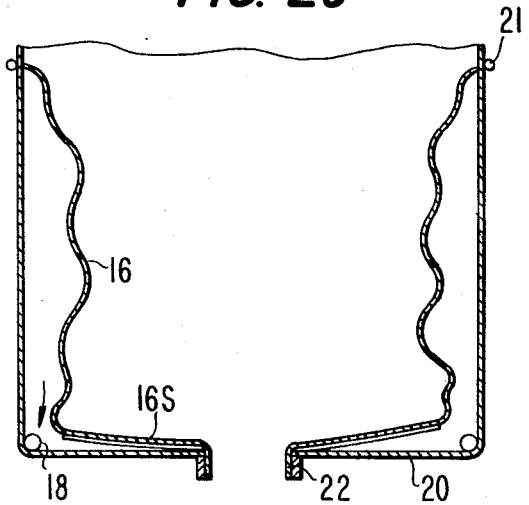
FIG. 2e
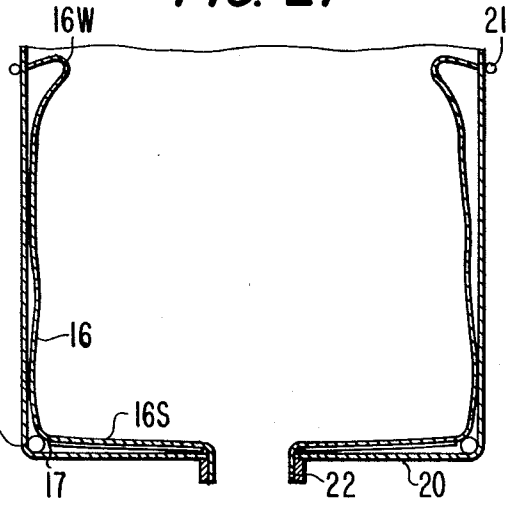
FIG. 2f

MATERIAL HANDLING BINS WITH INFLATABLE LINERS

This application is a continuation-in-part of application Ser. No. 686,532 filed Dec. 26, 1984 which in turn is a continuation-in-part of application Ser. No. 500,821 filed June 3, 1983, now U.S. Pat. No. 4,574,984.

BACKGROUND OF THE INVENTION

1. Field of the Invention

This invention relates to improvements in material-handling bins with a pneumatic discharge-assisted, dual-walled, cup-shaped bag or flexible liner and particularly to improvements in such bags or liners involving means for causing the inner wall bottom or floor portion to assume its original position on recycling.

2. Prior Art

The art on material-handling and storage-utilizing, inflatable, dual-wall, cup-shaped bags has been pioneered in inventions and patents licensed to and marketed by All-Flow, Inc. of Buffalo, N.Y. In U.S. Pat. No. 4,421,250 granted Dec. 20, 1983 there is disclosed such a dual-wall, cup-shaped bag supported from a stationary framework. In U.S. Pat. No. 4,449,646 granted May 22, 1984 there is disclosed a similar bag supported within a rigid outer wall and having slack at the top edges of the wall to prevent strain on the inner wall of the bag when refilling. In U.S. Pat. No. 4,476,998 granted Oct. 16, 1984 there is disclosed such a bag adapted for side discharge with a built-up area adjacent the discharge opening. In published European Patent Application No. 0 121 419 published Oct. 10, 1984 there is disclosed an assembly of such bags usable to convert a cargo space from handling piece goods to bulk goods and vice versa.

In connection with the use of such bags a problem sometimes arises in that the bottom or floor of the inner wall does not return to its original position following discharge of material. That is, after material is discharged from the bag and vacuum is applied to the space between the walls of the bag to return the inner wall of the bag to its original position, the bag will sometimes fall directly around the discharge opening and the vacuum will tend to hold the folds, thus preventing the remainder of the inner wall of the liner from lying flat on the outer wall of the bottom of the material handling space. This not only reduces the capacity of the bag, but also places significant strain on the top of the side portion of the inner wall of the bag when the bag is refilled. This problem became more acute when the bag is tall relative to its diameter. There exists a need in the art for an invention to solve this problem.

SUMMARY OF THE INVENTION

This invention provides a means for causing the inner wall bottom of a dual-wall, cup-shaped bag for pneumatic discharge-assisted material handling to return to its original position following material discharge and the application of vacuum for recycling. Such means is preferably constituted by stiffening in the floor portion only of the inner wall of the bag. This stiffening itself, while it could be additional plies of material or other means, is preferably a plurality of radially-positioned battens, the battens extending radially outwardly from a discharge opening in the bottom of the bag. By the use of such battens, or other stiffening means, the inner portion of the bag will, on the application of vacuum between the wall following a discharge cycle, fall back into place and not unduly wrinkle or pucker as had been the problem with certain of the previously known configurations.

BRIEF DESCRIPTION OF THE DRAWINGS

FIGS. 1*a*–1*f* show the bag in six sequential stages.

FIGS. 2*a*–2*f* are schematic illustrations of the dual-wall, cup-shaped bag of this invention showing the operation of the invention in the same six sequential stages as shown in FIGS. 1*a*–1*f*.

DETAILED DESCRIPTION OF THE PREFERRED EMBODIMENTS

Figure 1A:
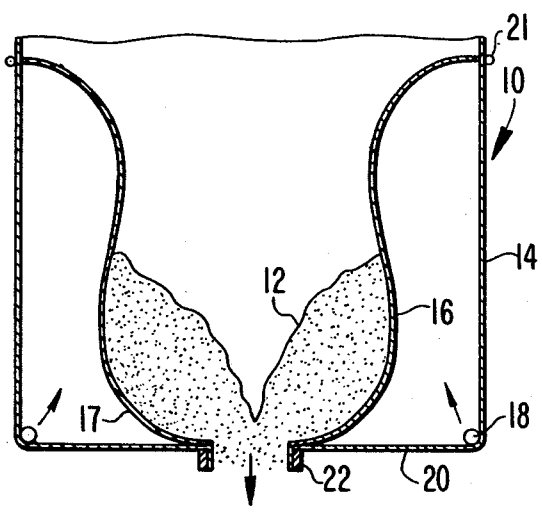
FIGS. 1*a*–1*f* are schematic illustrations of the steps in emptying a dual-wall, cup-shaped bag of prior art construction and illustrates the problem involved.

FIG. 1*a* shows a dual-wall, cup-shaped bag 10 for handling and discharging bulk material 12. The bag has an outer wall 14 and an inner wall 16 which together form an air-tight enclosure into which air may be added for inflation, e.g., through perforated ring 18 and withdrawn by vacuum through the same ring. A bottom portion 20 of the outer wall 14 would normally be in full position prior to start of material discharge and be covered by a bottom or floor portion 17 of the inner wall 16. An outlet 22 is provided for the discharge of material. This bag may be as described in any of the patents mentioned above. It may be suspended at the upper edge portion by ring 21 or by a portion of an outer wall (not shown) surrounding the outer bag wall 14.

FIG. 1*a* shows the condition of the bag during discharge in which the space between the walls is being inflated and the bulk product 12 is flowing by gravity out the discharge opening 22.

Figure 1B:
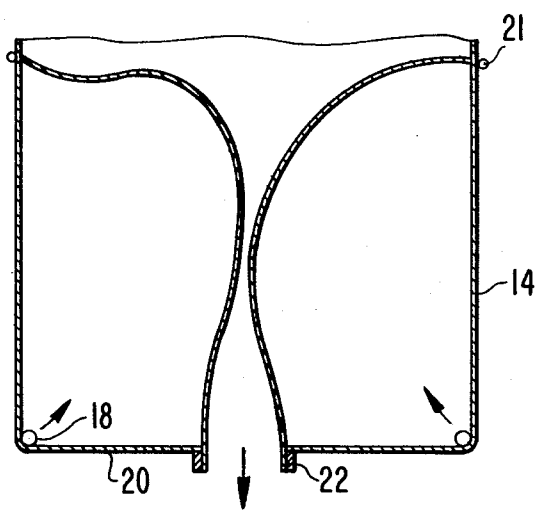

In FIG. 1*b* the inner liner 16 has inflated to the maximum, completely emptying the bulk product 12 from inside the bag 10. At this time the air pressure inside the membrane is sufficient so that the membrane is relatively hard. That is, with about 8 to 10 inches of water pressure inside the membrane, the fabric of the membrane is not continuously flexing.

Figure 1C:
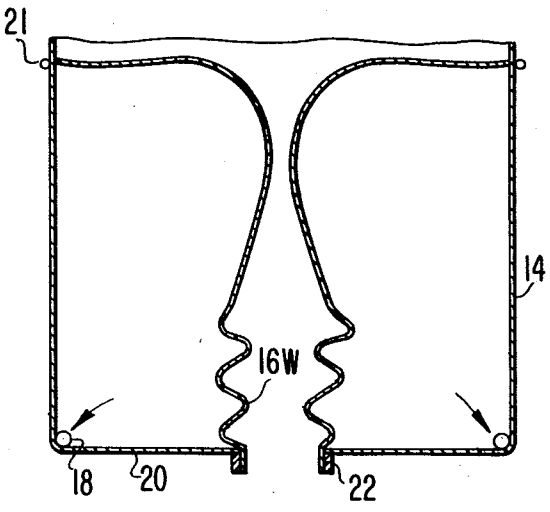

FIG. 1*c* shows the position of the inner wall 16 as the discharge-cycle has begun and the space between the bag walls is deflated so that the inner wall 16 begins to fall and wrinkles 16W appear around the discharge opening 22.

Figure 1D:
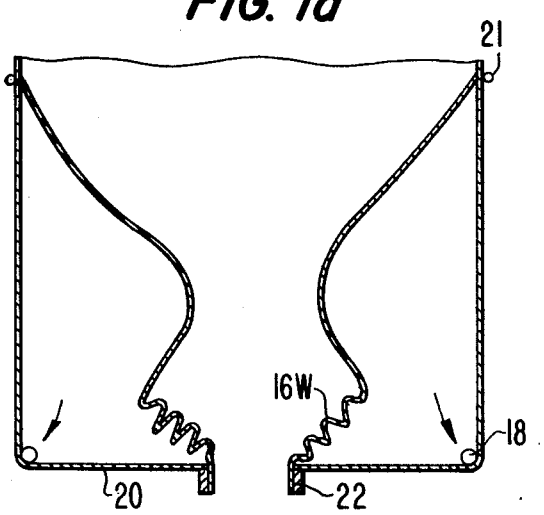

In FIG. 1*d* the deflation continues and the wrinkles 16W accentuate and begin to accumulate around the discharge opening 22.

Figure 1E:
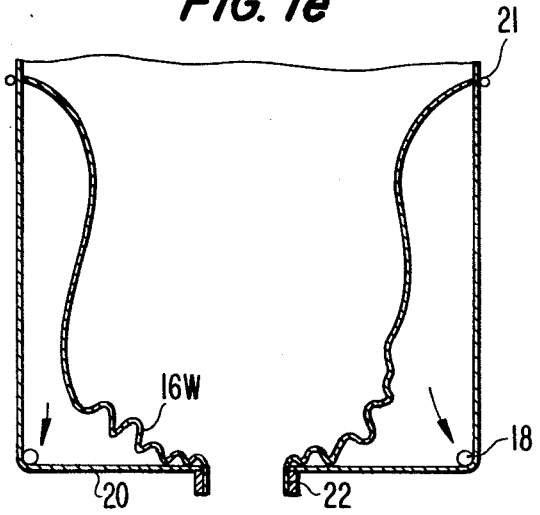

In FIG. 1*e* the vacuum has begun to hold several of the wrinkles 16W to the bottom portion 20 of the outer bag wall 14 around the discharge opening. As shown, there are several wrinkles and an accumulation of slack now held in place as a direct result of vacuum in the area, even though there may still be some air remaining in the area between the bag walls.

Figure 1F:
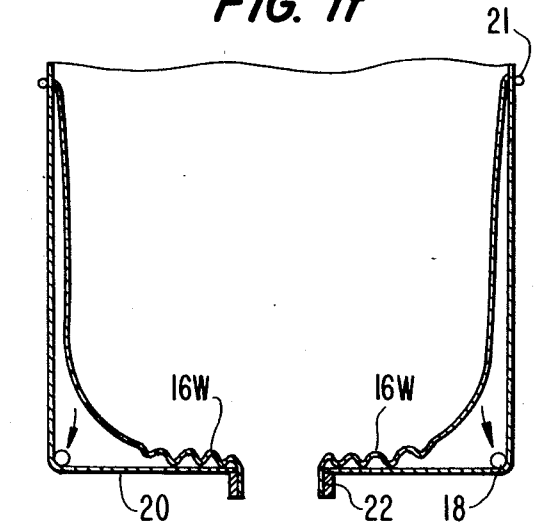

As shown in FIG. 1*f*, the deflation cycle is ending and only a small amount of air is left in the space between the bag walls. The wrinkled area 16W is pinned against the bottom 20 adjacent the discharge opening 22 and a vacuum is starting to appear around the perimeter of the bag. However, because the wrinkles in the slack are held against the floor, the inner liner 16 will not pull across the floor toward the outer wall and straighten out the wrinkles. The deflation cycle ends with the inner liner in the position shown in FIG. 1*f*. This creates a problem when the bin is reloaded. Note that there is no slack at the top edge of the inner wall 16 where it connects to support ring 21, and there should be slack at this point to take up any strain on the inner wall 16 when loading the bag 10 with material. When the material is loaded in the bag a significant stress will be created in the inner wall 16 at the point of its connection to support ring 21. This stress (indicated) can bend or break the top support ring 21 and connections between the support ring 21 and its support (not shown). It can also cause the fabric of bag 10 to tear away from the support 21.

FIGS. 2*a*–2*f* illustrate operation of a dual-wall, pneumatic discharge-assisted, cup-shaped bag with this invention applied thereto. The parts have the same reference numbers except that a portion of the inner wall bottom adjacent the discharge opening is provided with means for preventing the bottom portion of the inner wall from unduly wrinkling after material discharge, and causing the bottom wall to fall flat without substantial wrinkles on deflation after discharging material from the bag. Such means are preferably stiffening means 16S which will assure that the inner wall of the bag will fall flat and not wrinkle when the deflation cycle proceeds.

In FIG. 2*a* during the inflation cycle the inflation of the inner wall 16 is unaffected by the stiffening means 16S. The stiffening means is pliable enough that it bends easily and moves along with the liner without applying any stress or pressure. However, the stiffening means have enough resilience so that when the air pressure is eliminated in the bag the stiffening means will cause the bottom or floor portion 17 of the inner wall 16 to fall flat to thereby assume a flattened planar position.

FIG. 2*b* is similar to FIG. 1*b* showing complete inflation with the material completely emptied from the bag.

In FIG. 2*c* deflation has begun and pressure within the membrane drops to zero within about ten seconds into the deflation cycle. The bottom floor portion 17 of the inner liner 16 which is stiffened by stiffening means 16S is shown in a substantially vertical position and is straightened out without any substantial folds or wrinkles in it. As deflation continues, the use of stiffening means 16S prevents the inner liner from falling down and wrinkling or puckering around the discharge opening, rather it is forced to fall back toward the side walls.

FIG. 2*d* shows the deflation cycle continuing and the floor portion 17 of the inner liner falling back toward to the side walls due to the stiffening 16S.

FIG. 2*e* shows the deflation cycle almost complete. Note that the stiffened area has prevented any slack or any significant wrinkles from forming in the discharge area as was shown in FIGS. 1*d*–1*e*.

FIG. 2*f* shows complete deflation with the inner liner 16 back to the perimeter of the bottom of the cup-shaped bag, leaving the inner liner in proper position for reloading of bulk material. The stiffening means has caused the floor portion 17 of the inner liner to conform to the outer wall 20 in the floor area, as shown. Also, the slack area 16W that was previously wrinkled up around the discharge opening is now properly located at the top of the dual-wall bag so that any stretching force directed downwardly of the side walls on reloading can be taken up by the slack, as described in U.S. Pat. No. 4,449,646.

Figure 3:
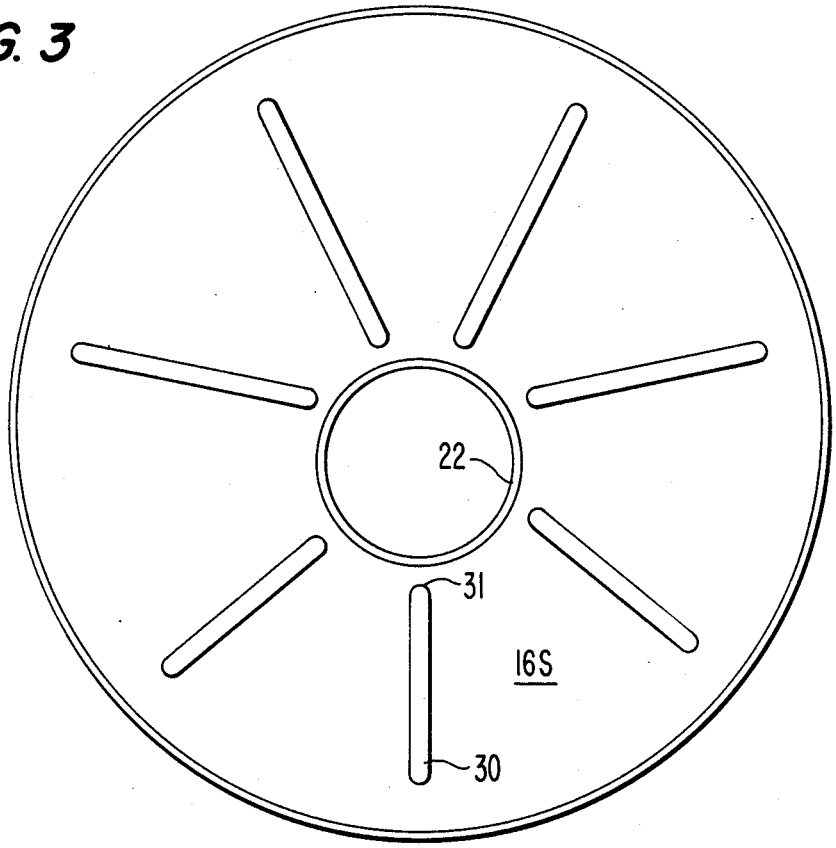
FIG. 3 is a top plan view showing the bottom inner liner of the bag of this invention.

FIG. 3 shows the preferred embodiment wherein the stiffening means 16S comprises a plurality of battens 30 which extend radially outwardly from a point near the discharge opening 22 toward the outer perimeter of the bag. Each batten preferably has a rounded end 31.

Figure 4:
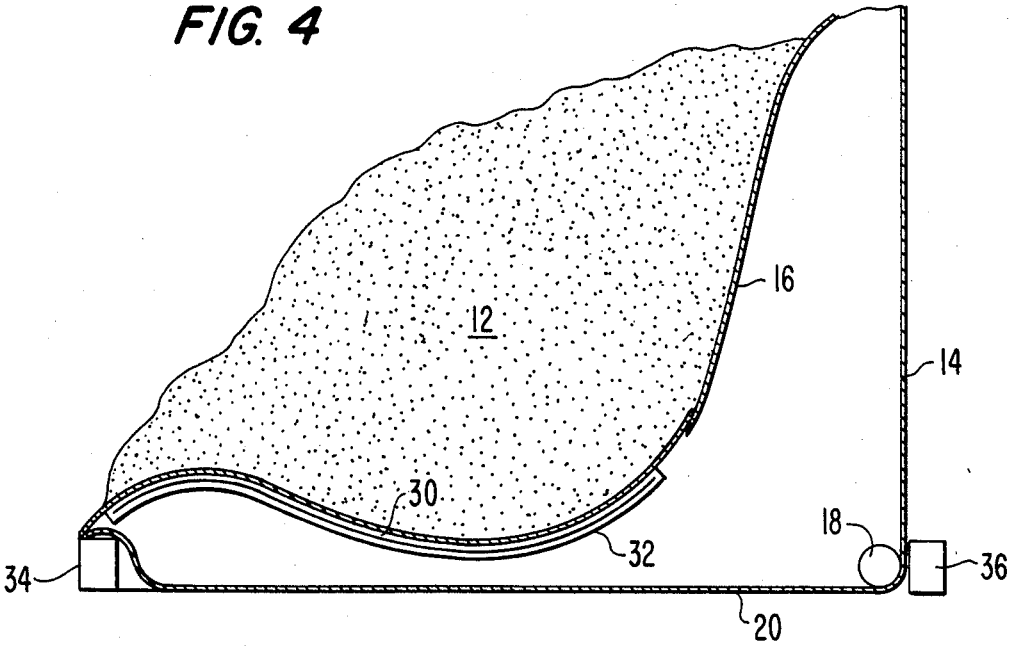
FIG. 4 is a vertical sectional elevation view through a portion of the bag of this invention showing bulk material therein and stiffening battens in the inner liner.

As shown in FIG. 4 each of the battens 30 may be housed within a pouch or envelope 32 in the inner liner 16. Also shown in FIG. 4 is a discharge ring 34 around the discharge opening 22 and a lower positioning ring 36 around the outside of the bottom of the outer liner.

In a preferred embodiment it was found that with a dual-wall 87"-diameter bag for use in a truck, seven battens approximately two inches wide and approximately $\frac{1}{8}$" thick, and of a plastic material, are sufficient. Note that the discharge opening is slightly off-center.

Although a plurality of battens as disclosed is the preferred way of stiffening, it is also within the scope of this invention to use other means such as a stiffened fabric by using an extra ply of stiffened fabric 16S in the floor area of the inner liner.

As can be seen, this invention discloses a successful solution to a vexing problem to assure that the inner liner of a dual-wall, cup-shaped bag for material-handling, pneumatic-assisted discharge is properly returned to the perimeter area immediately following deflation of the membrane.

Although the invention has been described in the environment of a dual-wall, cup-shaped bag, the principles of the invention can also be applied to a bin having a rigid outer cylindrical wall and a pressurized, flexible, cup-shaped liner therein, especially when the bin is small enough to be portable.

Because other means for accomplishing the results may be apparent to those skilled in the art, this is only as defined by the scope of the appended claims.

I claim:

1. A material-handling, pneumatic discharge-assisted, dual-walled, cup-shaped bag of the type having a flexible, generally cup-shaped, air impervious inner wall and a generally cup-shaped, air impervious outer wall providing an air impervious space therebetween capable of being inflated and deflated for the purpose of assisting material discharge when inflated and returning the inner wall of the membrane to an original cup-shaped position when deflated, the cup-shaped bag having a discharge opening in the bottom thereof, with the improvements comprising: stiffening means in a bottom wall portion of the inner wall for preventing the bottom portion of the inner wall from wrinkling after material discharge and on deflation, said stiffening means comprising a plurality of battens causing said bottom wall to fall flat without substantial wrinkles on deflation after discharging material from the bag.

2. A material-handling, pneumatic discharge-assisted, dual-walled, cup-shaped bag of the type having a flexible, generally cup-shaped, air impervious inner wall and a generally cup-shaped, air impervious outer wall providing an air impervious space therebetween capable of being inflated and deflated for the purpose of assisting material discharge when inflated and returning the inner wall of the membrane to an original cup-shaped position when deflated, the cup-shaped bag having a discharge opening in the bottom thereof, with the improvements comprising: stiffening means in a bottom wall portion of the inner wall for preventing the bottom portion of the inner wall from wrinkling after material discharge and on deflation, said stiffening means comprise a plurality of battens, said battens extending radially from adjacent the discharge opening to adjacent the periphery of the bottom of the cup-shaped bag, said means causing said bottom wall to fall flat without substantial wrinkles on deflation after discharging material from the bag.

3. A bag as in claim 2 wherein the battens are contained in pouches on a side of the inner wall of the bag between the inner wall and the outer wall.

4. A bag as defined in claim 3 wherein the battens have rounded ends.

5. A material-handling, pneumatic discharge-assisted bin having a flexible, generally cup-shaped, air impervious flexible membrane type inner wall, and a cylindrical outer wall providing an air impervious space therebetween capable of containing pressure or vacuum for the purpose of flexing the inner wall and assisting material discharge when pressure is applied and returning the inner wall of the membrane to an original cup-shaped position when vacuum is applied, the bin and the flexible membrane inner wall having a discharge opening in the bottom thereof, with the improvements comprising: stiffening means in a bottom wall portion of the inner wall for preventing the bottom portion of the inner wall from wrinkling after material discharge and on deflation, said stiffening means comprising a plurality of battens causing said bottom wall to fall flat without substantial wrinkles on deflation after discharging material from the bag.

6. A material-handling, pneumatic discharge-assisted bin having a flexible, generally cup-shaped, air impervious flexible membrane type inner wall, and a cylindrical outer wall providing an air impervious space therebetween capable of containing pressure or vacuum for the purpose of flexing the inner wall and assisting material discharge when pressure is applied and returning the inner wall of the membrane to an original cup-shaped position when vacuum is applied, the bin and the flexible membrane inner wall having a discharge opening in the bottom thereof, with the improvements comprising; stiffening means in a bottom wall portion of the inner wall for preventing the bottom portion of the inner wall from wrinkling after material discharge and on deflation, said stiffening means comprise a plurality of battens, said battens extending radially from adjacent the discharge opening to adjacent the periphery of the bottom of the cup-shaped bag, said means causing said bottom wall to fall flat without substantial wrinkles on deflation after discharging material from the bag.

* * * * *